US006920758B2

(12) United States Patent
Matsuyama et al.

(10) Patent No.: US 6,920,758 B2
(45) Date of Patent: Jul. 26, 2005

(54) GAS TURBINE AND THE COMBUSTOR THEREOF

(75) Inventors: Keisuke Matsuyama, Takasago (JP); Katsunori Tanaka, Takasago (JP); Yasuhiko Ikegami, Takasago (JP); Masaki Ono, Takasago (JP); Kazufumi Ikeda, Takasago (JP)

(73) Assignee: Mitsubishi Heavy Industries Ltd., Tokyo (JP)

( * ) Notice: Subject to any disclaimer, the term of this patent is extended or adjusted under 35 U.S.C. 154(b) by 72 days.

(21) Appl. No.: 10/231,004

(22) Filed: Aug. 30, 2002

(65) Prior Publication Data

US 2003/0051478 A1 Mar. 20, 2003

(30) Foreign Application Priority Data

Aug. 31, 2001 (JP) ..... 2001-264189

(51) Int. Cl.[7] ..... F02C 3/00
(52) U.S. Cl. ..... 60/725; 431/114
(58) Field of Search ..... 60/723, 725, 746; 181/213; 431/114

(56) References Cited

U.S. PATENT DOCUMENTS 4,122,674 A * 10/1978 Andersson et al. ..... 60/725
6,532,742 B2 * 3/2003 Scarinci et al. ..... 60/725
6,594,999 B2 * 7/2003 Mandai et al. ..... 60/725
6,662,564 B2 * 12/2003 Bruck et al. ..... 60/723

FOREIGN PATENT DOCUMENTS

JP 11-141878 * 5/1999

* cited by examiner

*Primary Examiner*—Michael Koczo
(74) *Attorney, Agent, or Firm*—Oblon, Spivak, McClelland, Maier & Neustadt, P.C.

(57) ABSTRACT

The objective is to provide a gas turbine and the combustor thereof in which super high frequency combustion oscillation and the generation of NOx are reduced.

The fluctuation in pressure which induces the fluctuation in heat liberation is suppressed in the gas turbine combustor comprising a plurality of main fuel supply nozzles, each having a premixing nozzle at the top end part thereof, by providing in the space upstream from the premixing nozzles partition elements for dividing the space along the axis of the combustor or a honeycomb element having air passages in the axial direction, or by providing premixing nozzles composed of cylindrical elements with many holes.

5 Claims, 6 Drawing Sheets

GAS TURBINE AND THE COMBUSTOR THEREOF

BACKGROUND OF THE INVENTION

1. Field of the Invention

The present invention relates to a gas turbine and the combustor thereof with reduced super high frequency oscillation of combustion and with reduced emission of NOx.

2. Description of the Related Art

FIG. 6 is a longitudinal sectional view near the combustor of a gas turbine equipped with a conventional combustor. The conventional combustor will be explained here with reference to the drawing. In FIG. 6, reference numeral 101 is a combustor mounted to a rotor housing 102.

The combustor 101 has a fuel supply nozzle 103, a liner(flame tube) 104, and a tail tube 105. Reference numeral 106 is an outer casing. A bypass elbow 107 is attached to the tail tube 105. Reference numeral 108 is a bypass valve and 109 is an adjusting mechanism of the bypass valve 108.

Reference numeral 110 is an air compressor. The compressed air 111 discharged from the compressor 110 flows inside the rotor housing 102, passes around the combustor 101 as indicated by arrows, and introduced into the combustor 101 as combustion air from the upstream side of the fuel supply nozzle 103.

The combustor 101 shown in FIG. 6 is composed as described above, the fuel supplied through the fuel supply nozzles 103 is burnt, and the combustion gas is transmitted to the turbine blade part 112 to drive the turbine rotor.

The gas turbine is operated in a wide range of load and speed from start to the rated output. Therefore, it is required that the fuel is burned stable in the combustor of the gas turbine responding to the wide range of operation conditions such as air and fuel flow rate from the start to rated output.

Also, in order to reduce Nitrogen Oxide (Nox) discharged from the gas turbine combustor, a method capable of suppressing the Nox emission is strongly required.

Premixed combustion is a method of combustion to reduce the generation of NOx. In large, NOx generation increases exponentially with combustion flame temperature. By allowing the fuel to burn in a state of premixed combustion, local elevation of the combustion flame temperature can be prevented. Therefore, NOx emission can be reduced by lowering the combustion flame temperature through obtaining a lean mixture by increasing the ratio of air to fuel. Recently, to meet with the requirement for much further reduction in NOx emission, the proportion operated in lean premixed combustion is increasing.

However, in lean premixed combustion, generally a flame blowout is easy to occur as compared with diffusive combustion in which fuel burns while mixing with air, and also combustion oscillation is easy to occur. In addition, the stable operation is limited. Therefore, it is necessary to attain the reduction of NOx emission while securing stable combustion that diffusive combustion and lean premixed combustion are combined properly.

FIG. 4 shows schematically a structure of the conventional combustor in which diffusive combustion and lean premixed combustion is properly combined. Here, the structure will be briefly explained. The combustor is composed of a pilot burner 01 for diffusive combustion provided on the center axis of a substantially cylindrical flame tube(liner) 6, the pilot burner 01 being provided with a pilot fuel supply nozzle 3 having a pilot swirler vane O1*a* attached around the top end part of the pilot fuel supply nozzle 3; and premixed combustion burners 02 having eight main fuel supply nozzles 2*a*, arranged surrounding the pilot burner 01, premixing nozzles 4*a*, being arranged around the top end part each of the main fuel supply nozzles 2*a*, a disk-like nozzle plate 7 and a premixing swirler vane 5, being provided annular space between each of the main fuel supply nozzles 2*a*, and premixing nozzles 4*a*.

In a combustor like this, pilot fuel is supplied from the pilot fuel supply nozzle 3, combustion air for burning the pilot fuel is supplied from around the pilot nozzle to effect pilot combustion which is of diffusive flame (hereunder referred to as pilot flame) in the central part of the combustor. Around the pilot flame is supplied fuel/air mixture of very high air excess ratio to be contacted with the high temperature gas of the pilot flame so as to effect main combustion composed of premixed flames (hereunder referred to as main flames).

The premixed combustion burners 02 are arranged surrounding the pilot burner 01 to allow the premixed combustion burners 02 to be located adjacent to the pilot burner 01, so the mixture spraying from the premixing nozzle 4*a*, mixes with the diffusive combustion flames of the pilot combustion, which dispersed by the swirling flow effected by the pilot swirler 01*a*, to be burned continually, the combustion air flow rate for the pilot burner 01 can be reduced, and the rate of premixed combustion can be increased resulting in reduced NOx emission.

In the drawing, reference numerals 1*a* and 1*b* show airflow, 8 shows combustion flame, 9 shows a node line of sound pressure (nodes of sound pressure: ND)).

However, with the prior art described above, combustion oscillation of very high frequency (super high-frequency combustion oscillation) which forms the acoustic mode (sound pressure mode) in the plane transversal to axis of the combustor occurs due to the coupling of the acoustic system and combustion system.

Currently, the super high-frequency combustion oscillation is suppressed by enhancing the effect of damping in the acoustic system, for example, by providing a cylindrical element with many holes 10 in the combustion zone 8 along the inner circumference of the flame tube 6, as shown in FIG. 5. However, as the cylindrical element with many holes 10 is located in the high temperature zone of combustion, design consideration of heat resistance and cooling of the cylinder is inevitable, which results in a complicated structure and increased manufacturing costs.

There are the cases the combustor has not only one node line (1ND) but a plurality of node lines of higher order of sound mode as shown in FIG. 3.

For example, FIG. 3(A) shows the case in which there are two node lines of $2^{nd}$ order which partition the plane transversal to the axis of the combustor into four vibration zones of +−+− on, FIG. 3(B) shows the case in which there are three node lines of $3^{ird}$ order which partition the plane into six vibration zones of +−+−+−, and FIG. 3(B) shows the case in which there are four node lines of $4^{th}$ order which partition the plane into eight vibration zones of +−+−+−+−.

SUMMARY OF THE INVENTION

The present invention is made on the light of the problem mentioned above, the objective is to provide a gas turbine and the combustor thereof in which super high frequency combustion oscillation and the generation of NOx are reduced.

To be more specific, since said combustion oscillation is the coupled vibration of the pressure fluctuation in the acoustic system and the fluctuation in heat liberation in the combustion system, the present invention aims at providing an art to achieve said objective particularly by suppressing said combustion oscillation through suppressing the pressure fluctuation which induces the fluctuation in heat liberation.

The present invention intends to solve the problem by providing a gas turbine comprising a combustor which is provided with a plurality of main fuel supply nozzles, each nozzle having a premixing nozzle at the top end part thereof, around a pilot burner located on the center axis of a flame tube; composed so that the air compressed by the air compressor of the gas turbine is introduced into the combustor as combustion air; and comprising a sound pressure suppressing means for suppressing the propagation of sound pressure in the direction along a section transversal to the axis of the combustor in the circumferential direction around the axis thereof while allowing the free flow of air passing therethrough provided in the space where said premixing nozzles are located or in the space upstream therefrom. Particularly, said combustor of the gas turbine is provided with a sound pressure suppressing means for suppressing the propagation of sound pressure in the direction along a section transversal to the axis of the combustor in the circumferential direction around the axis thereof while allowing the free flow of air passing therethrough provided in the space where said premixing nozzles are located or in the space upstream therefrom. Said sound pressure suppressing means is one or a plurality of partition members with many holes, which partition the space around one or a plurality of premixing nozzles or the space upstream therefrom along the axial direction of the combustor; or a honeycomb like element having air passages in the axial direction of the combustor, the element being provided in the space around one or a plurality of premixing nozzles or in the space upstream therefrom; or premixing nozzles, each of the nozzles being composed of a porous cylindrical element.

Said sound pressure suppressing means may be a combination of said premixing nozzles composed of porous cylindrical elements and said partition members with many holes or said honeycomb like element.

The present invention is explained below.

It is thought that said fluctuation in heat liberation is due to the fluctuation in the state of mixing of fuel and air at the premixing nozzles and this fluctuation is propagated through the premixing nozzles to the upstream side. The combustion oscillation of super high frequency is a plane vibration having nodes on the planes orthogonal to the axis of the flame tube, i.e. plane mode vibration as shown in FIG. 3, so interaction between the nozzles occurs also in the upstream side of the premixing nozzles. By preventing or restricting the propagation of the sound pressure of this part by partition plates such as plates with many holes or pressure shield plates, the suppression of the propagation of sound pressure in the direction along a section transversal to the axis of the combustor (cluster of premixing nozzles) in the circumferential direction around the axis thereof is possible and the super high frequency combustion oscillation can be suppressed.

As said partition plates are, for example, plates having many holes, sound pressure is shielded but air flows freely. The principle of sound pressure reduction of the plate with many holes is that the sound pressure energy is reduced due to the resistance by the holes. There is no particular restriction about the plate with many holes 35 so far as it shields the sound pressure and allows air to pass through. For example, it may be formed of punched-metal, steel meshwork, sintered ceramic, sintered meshwork of stainless steel or heat-resisting steel, etc.

As the plates 34 with many holes 35 are provided between adjacent premixing nozzles, it is preferable to locate the plates in each space between adjacent premixing nozzles so that the number of plates with many holes 35 corresponds with the number of the premixing nozzle. However, it is not necessary, depending on the sound mode, that they are located between adjacent nozzles, one plate nozzles may be located for each of two premixing nozzles, or the plates may be located at 2•1•2•1 intervals of the premixing nozzles. There may occur the case an odd number of the plates are provided for an even number of the premixmg nozzles, or an even number of the plates are provided for an odd number of the premixing nozzles. The plates with many holes may be located between adjacent premixing nozzles at an equal interval or at unequal intervals.

Further, by forming the premixing nozzles of porous material so as to suppress the fluctuation in the state of fuel/air mixing at the premixing nozzles, the propagation of sound pressure in the direction along a section transversal to the axis of the combustor (cluster of premixing nozzles) in the circumferential direction around the axis thereof be further more suppressed, resulting in the suppression of the super high frequency oscillation of combustion.

It is also suitable that the space where said premixing nozzles are located or the space of its upstream side is stuffed with a honeycomb like element having air passages in the axial direction of the combustor.

DETAILE DESCRIPTION OF THE PREFERRED EMBODIMENT

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1B:
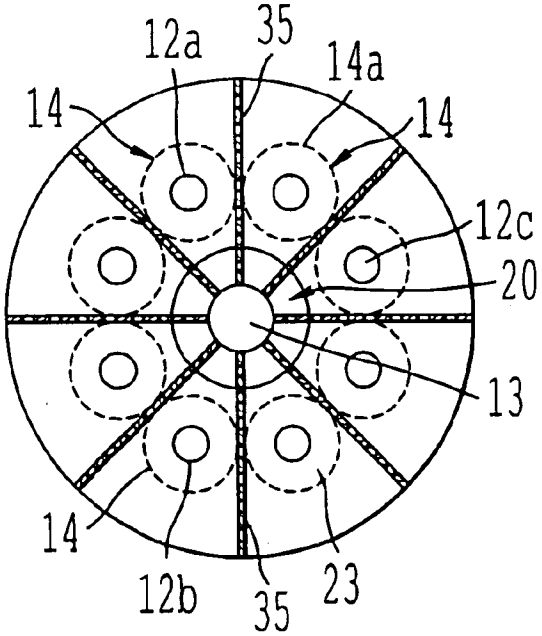
FIG. 1(B) is a cross sectional view thereof.
Figure 1A:
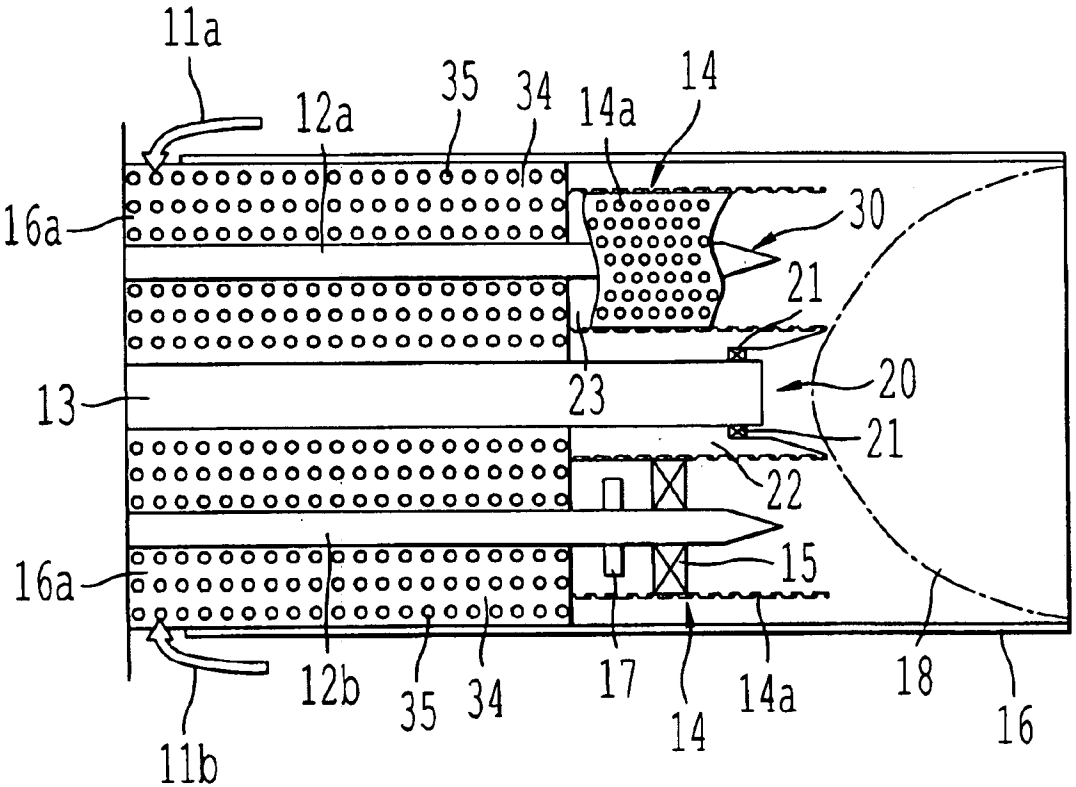
FIG. 1(A) is a longitudinal sectional view showing the inner structure of the combustor of first embodiment according to the present invention.

FIGS. 1(A), (B) are schematic illustrations of a combustor in which diffusion combustion is combined with premixed combustion, FIG. 1(A) is a longitudinal sectional view showing the inner structure of the combustor of first embodiment according to the present invention, and FIG. 1(B) is a cross sectional view thereof.

In the drawings, the combustor is composed of a pilot burner 20 for diffusive combustion provided on the center axis of a substantially cylindrical flame tube (liner) 16, the pilot burner 20 being provided with a pilot fuel supply nozzle 13 having a pilot swirler vane 21 attached around the top end part of the pilot fuel supply nozzle 13; and premixed combustion burners 30 having eight main fuel supply nozzles 12*a*, arranged surrounding the pilot burner 20, premixing nozzles 14, being arranged around the top end part each of the main fuel supply nozzles 12*a*, a disk-like nozzle plate 17 and a premixing swirler vane 15, being provided in the annular space between each of the main fuel supply nozzles 12*a*, and premixing nozzles 14.

Pilot fuel is supplied from the pilot fuel supply nozzle 3, combustion air for burning the pilot fuel is supplied from around the pilot nozzle to effect pilot combustion which is in the form of diffusive flame in the central part of the combustor. Around the pilot flame is supplied fuel/air mixture of very high air excess ratio to be contacted with the high temperature gas of the pilot flame so as to effect main combustion composed of premixed flames (main flames). This is the same as the case of combustor of the prior art. To be more specific, in the gas turbine combustor, pilot fuel is supplied from the pilot fuel supply nozzle 13 extending along the center axis of the flame tube 16, and a pilot air supply passage 22 is formed around the pilot fuel supply nozzle 13. A pilot swirler 21 for holding flame is provided in the pilot air supply passage 22. Further, main fuel supply nozzles 12*a*, for supplying the fuel for main combustion, main air supply passages 23, and premixing swirl vane 15, are provided around the pilot air supply passage 22.

The pilot fuel supplied from the pilot fuel supply nozzle 13 mixes with the air supplied through the pilot air supply passage 22 to be burned at the outlet side of the passage, and a pilot flame of high temperature is formed. The fuel supplied from the main fuel supply nozzles 12*a*, mixes with the air supplied through the main air supply passage 23 in the mixing zones formed downstream from the premixing nozzles 14, to be formed into a fuel/air mixture. The fuel/air mixture contacts with the pilot flame, and the main flame 18 is formed. In the drawing, reference numeral 11*a* and 11*b* show airflow.

The combustion oscillation generated in a combustor of the structure like this is the coupled vibration of the pressure fluctuation in the acoustic system and the fluctuation in heat liberation in the combustion system. According to the present invention, particularly the pressure fluctuation which induces the fluctuation in heat liberation can be suppressed.

Figure 3A:
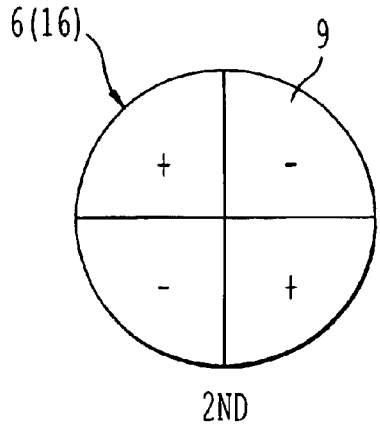
FIG. 3(A) are illustrations showing modes of the sound pressure in the combustor, (A) shows the case in which there are two node lines of of $2^{nd}$ order, (B) shows the case in which there are three node lines of $3^{ird}$ order, and (C) shows the case in which there are four node lines of $4^{th}$ order.
Figure 3B:
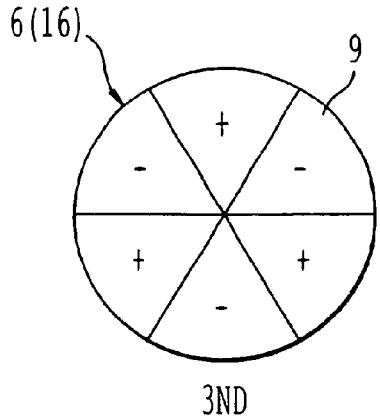
Figure 3C:
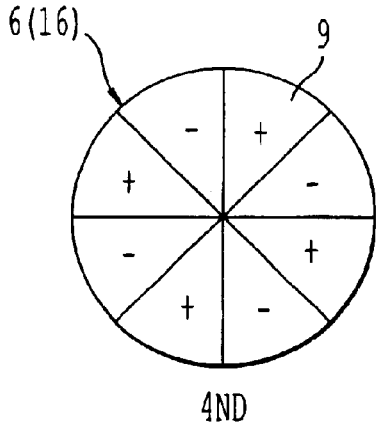
Figure 4B:
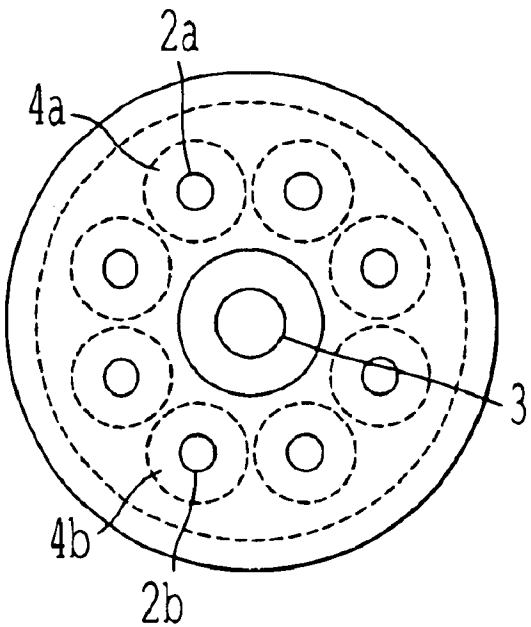
FIG. 4B PRIOR ART
FIG. 4(B) is a cross sectional view thereof.
Figure 4A:
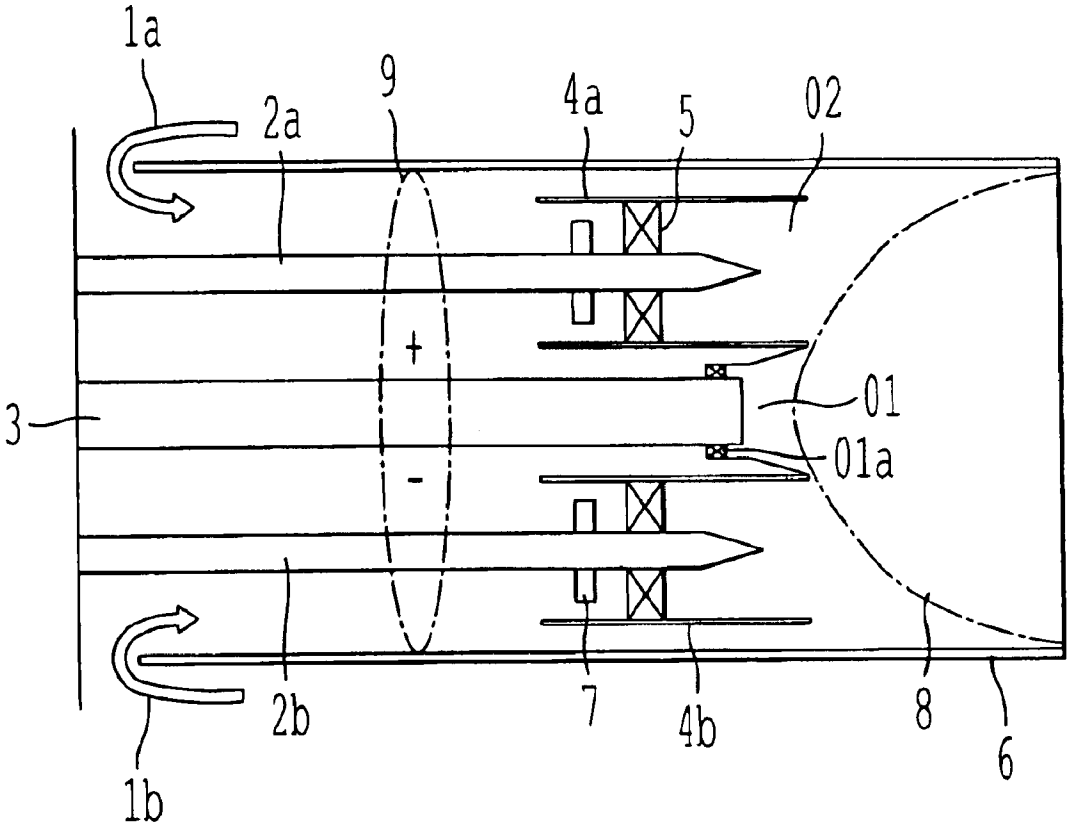
FIG. 4A PRIOR ART
FIG. 4(A) is a longitudinal sectional view showing the inner structure of the combustor of the first example of prior art.
Figure 5B:
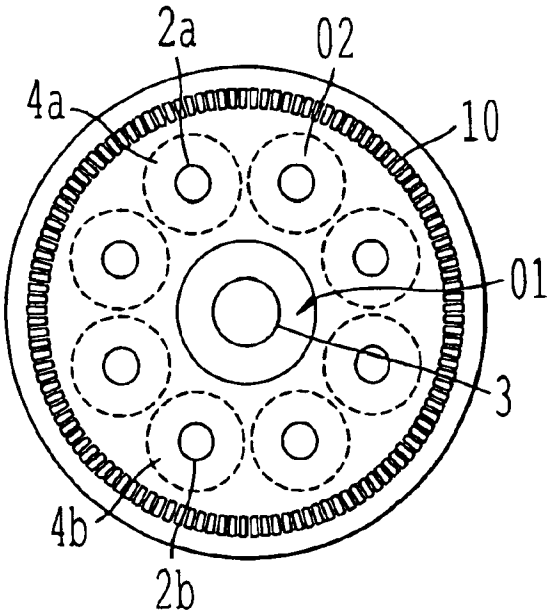
FIG. 5B PRIOR ART
FIG. 5(B) is a cross sectional view thereof.
Figure 5A:
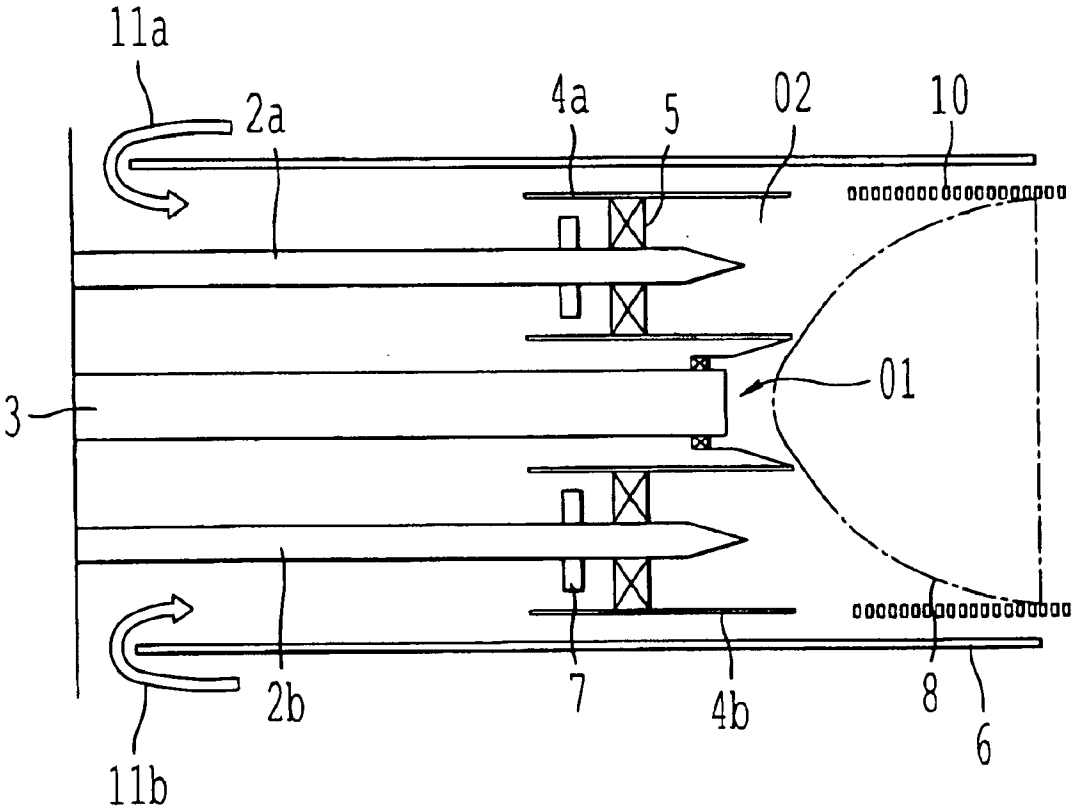
FIG. 5A PRIOR ART
FIG. 5(A) is a longitudinal sectional view showing the inner structure of the combustor of the second example of prior art.
Figure 6:
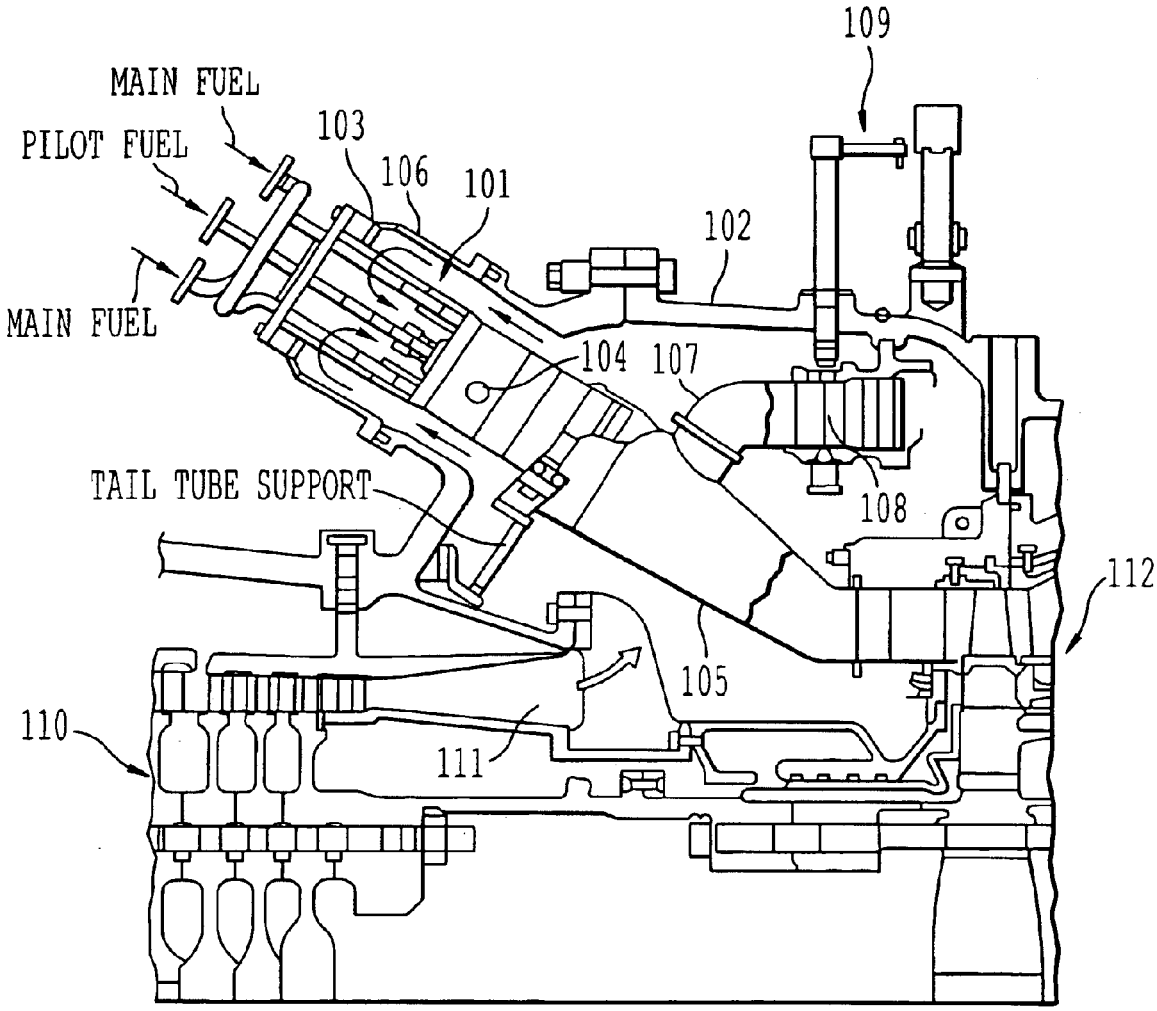
FIG. 6 PRIOR ART
FIG. 6 is a longitudinal sectional view of a gas turbine near the combustor, the combustor of the present invention and the prior art being applicable to the gas turbine.

It is thought that the fluctuation in heat liberation is due to the fluctuation in the state of mixing of fuel and air at the premixing nozzles and this fluctuation is propagated through the premixing nozzles to the upstream side. The combustion oscillation is of super high frequency and is a plane vibration having nodes on the planes orthogonal to the axis of the flame tube, i.e. plane mode vibration as shown in FIG. 3, so interaction between the nozzles occurs also in the upstream side of the premixing nozzles 14.

Therefore, in an embodiment of the present invention, the propagation of sound pressure on the planes orthogonal to the axis of the flame tube is prevented or restricted by partitioning with plates 34 having many holes 35 provided in the space between the adjacent premixing nozzles 14, 14 or the space between the adjacent premixing nozzle 14, 14 in the upstream side.

There is no particular restriction about the plates 34 with many holes 35 since it shields the sound pressure and allows air to pass through. For example, it may be formed of punched-metal, steel meshwork, sintered ceramic, sintered meshwork of stainless steel or heat-resisting steel, etc.

Said plates 34 with many holes 35 are located extending in the longitudinal direction along the airflow from the opening for air intake 16*a* of the flame tube to the root of the premixing nozzles 14, i.e. upstream from the premixing nozzles 14 and extending radially from the periphery of the pilot fuel supply nozzle 13 to the inner radius of the flame tube 16 in the spaces between adjacent premixing nozzles.

To be more specific, when eight premixing nozzles are provided from the position deviated by 22.5° from a vertical line in the circumferential direction at 45° interval as shown in FIG. 1(B), eight plates 34 with many holes 35 are located radially at 45° interval in the vertical, horizontal, and two slanting directions. By providing the plates 34 with many holes 35 like this, each longitudinal space around each premixing nozzle 14 is partitioned into each independent space along each premixing nozzle 14. Therefore, air can flow through each independent space but the propagation of sound pressure in the direction along a section transversal to the axis of the combustor in the circumferential direction around the axis thereof can be suppressed. Accordingly, the occurrence of interaction between the premixing nozzles and the propagation of the sound pressure due to the interaction is prevented, resulting in the suppression of the super high frequency combustion oscillation.

As the plates 34 with many holes 35 are provided between adjacent premixing nozzles, it is preferable to locate the plates in each space between adjacent premixing nozzles so that the number of plates 34 with many holes 35 correspond with the number of the premixing nozzles. However, one plate may be located for each of two premixing nozzles, or the plates may be located at 2.1.2.1 intervals of the premixing nozzle. In this case, there may occurs the case in which an odd number of the plates are provided for an even number of the premixing nozzles, or an even number of the plates are provided for an odd number of the premixing nozzles.

In the drawing, the plates 34 with many holes 35 are located between adjacent premixing nozzles at an equal interval of 45°, however, it is suitable to provide at deferent interval, for example, at intervals of 40°/45°/40°/50°, depending on sound pressure mode.

Further, by forming the premixing nozzle 14 into a cylindrical component with many holes 14*a* by utilizing porous ceramic material or porous material such as sintered metal, the fluctuation in the state of fuel/air mixing at the premixing nozzles 14*a* is suppressed by said cylindrical component with many holes 14*a* while maintaining smooth airflow in the axial direction, and the propagation of sound pressure in the direction along a section transversal to the axes of the premixing nozzles 14, 14 in the circumferential direction around the center axis of the flame tube 16 is suppressed, resulting in suppressed combustion oscillation of super high frequency.

Figure 2B:
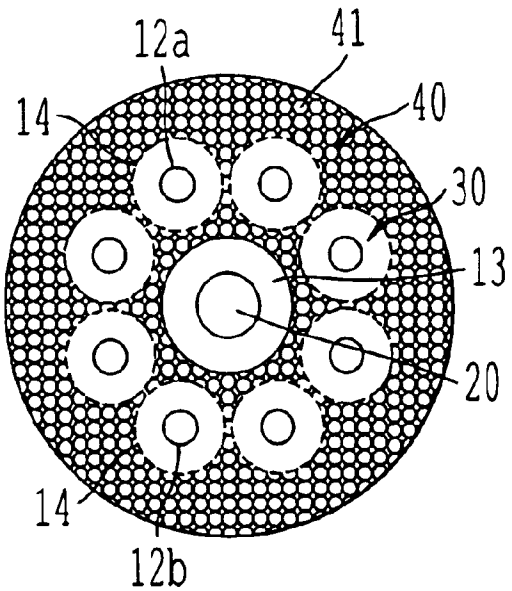
FIG. 2(B) is a cross sectional view thereof.
Figure 2A:
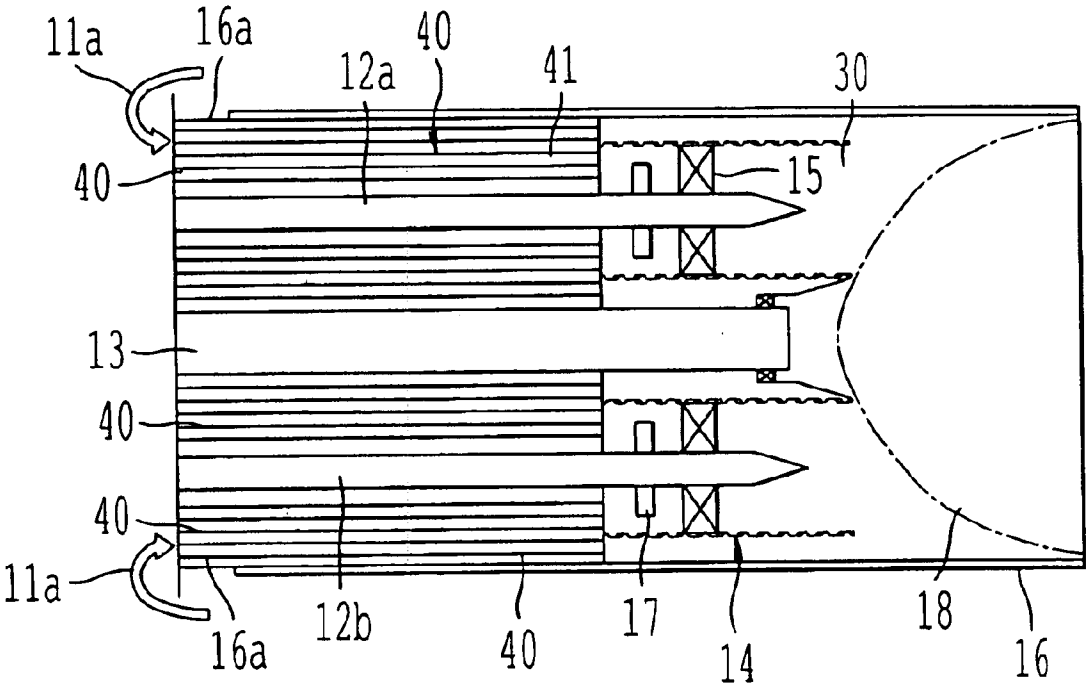
FIG. 2(A) is a longitudinal sectional view showing the inner structure of the combustor of second embodiment according to the present invention.

FIG. 2 is another embodiment of the combustor in which a honeycomb like element 40 having a large number of air passages 41 in the axial direction is provided in the space where the premixing nozzles are arranged or in the upstream part thereof. Said honeycomb like element 40 is located inside the flame tube 16 extending from the opening for air intake 16*a* of the flame tube 16 to the root of the premixing nozzle 14, the air passages 41 extending along the direction of air flow in the axial direction.

In the embodiment, the upstream side of the premixing nozzles 14 is subdivided into a large number of independent air passages by said honeycomb like element 40, the propagation of sound pressure in the plane orthogonal to the axis of the flame tube is effectively prevented, while the air flows freely through the air passages 41.

As has been described in the foregoing, according to the present invention, the propagation of sound pressure in the direction along a section transversal to the axis of the combustor (cluster of premixing nozzles) in the circumferntial direction around the axis thereof can be suppressed. As a result, super high frequency combustion oscillation can be suppressed.

What is claimed is:

1. A combustor for a gas turbine provided with a plurality of main fuel supply nozzles provided around a pilot burner located on the center axis of a flame tube, each main fuel supply nozzles having a premixing nozzle at an end part thereof, and a sound pressure suppressing device for suppressing the propagation of sound pressure in the direction along a section transversal to a longitudinal axis of the combustor in the circumferential direction around the axis thereof while allowing the free flow of air passing therethrough provided in one of a space where said premixing nozzles are located and a space upstream therefrom.

2. A combustor for a gas turbine according to claim 1, wherein said sound pressure suppressing device comprises one of a single partition member and a plurality of partition members with a plurality holes, which partition a space around at least one premixing nozzle and a space upstream therefrom along the axial direction of the combustor.

3. A combustor for a gas turbine according to claim 1, wherein said sound pressure suppressing device comprises premixing nozzles, each of which comprises a porous cylindrical element.

4. A combustor for a gas turbine according to claim 2, wherein said sound pressure suppressing device comprises a combination of the premixing nozzles composed of porous cylindrical elements and the partition members with said holes.

5. A combustor for a gas turbine according to claim 1, wherein said sound pressure suppressing device comprises a combination of said premixing nozzles comprising porous cylindrical elements and a honeycomb-like element.

* * * * *